US006394301B1

(12) United States Patent
Koch

(10) Patent No.: US 6,394,301 B1
(45) Date of Patent: May 28, 2002

(54) SHIPPING AND DISPLAY CONTAINER FOR CHAIN AND BULK GOODS

(76) Inventor: James S. Koch, 2045 Kimberly Ct., Minneapolis, MN (US) 55447

( * ) Notice: Subject to any disclaimer, the term of this patent is extended or adjusted under 35 U.S.C. 154(b) by 0 days.

(21) Appl. No.: 09/882,425

(22) Filed: Jun. 18, 2001

(51) Int. Cl.[7] ..... B65D 1/42
(52) U.S. Cl. ..... 220/646
(58) Field of Search ..... 220/675, 673, 220/213, 796, 763, 762, 767, 768, 646; 206/509; 215/382, 385; 229/164, 939; 190/113

(56) References Cited

U.S. PATENT DOCUMENTS 4,179,040 A * 12/1979 Bateman et al. ..... 206/804
4,651,662 A * 3/1987 Brauch et al. ..... 112/258
4,830,185 A * 5/1989 Colletti ..... 206/449
5,226,553 A * 7/1993 Fiore ..... 206/315.11
5,507,389 A * 4/1996 Syrek ..... 206/508
5,637,420 A * 6/1997 Jones et al. ..... 16/DIG. 15

* cited by examiner

*Primary Examiner*—Stephen Castellano
(74) *Attorney, Agent, or Firm*—James R. Cwayna

(57) ABSTRACT

A shipping and display container for use for bulk materials, particularly directed to use with chain, providing an upright container having a rectangular cross section and of a predetermined height and width to accommodate the shipping and display, for merchandising, chain in bulk. For shipping a corner closure cover is provided which is removable to allow access to the chain contained therein. The resulting access aperture, upon cover removal, is provided at a forward portion of the top and extending downwardly of the container. The bottom of such opening has a chain engaging notch for holding at least a chain link. The container is provided with upwardly arranged, strengthening columns formed integrally thereof and the bottoms and tops of the containers are shaped to permits vertical nesting and stacking of the same. A collapsible and nesting handle is provided in at least one column area to assist in handling of the unit.

8 Claims, 6 Drawing Sheets

SHIPPING AND DISPLAY CONTAINER FOR CHAIN AND BULK GOODS

RELATED APPLICATIONS

Applicant has not filed and also is not aware of any applications which have been filed by others that relate to the invention disclosed and claimed in this application.

SPONSORSHIP

This invention has been made through the single and sole effort of the named inventor and there has been neither Federal or Independent Sponsorship of the applicant, inventor.

FIELD OF THE INVENTION

This invention relates to shipping, display and ultimately reusable containers for merchandise and more specifically to a container devised for the shipping and ultimate display and sale of chain, as well as other materials, in bulk, with a removable cover portion to allow access to the chain or bulk goods with, specifically for chain, a link retainer in the opening to prevent the chain from slipping back into the container. The container is specifically designed to reduce "dead" floor display area and thus make more efficient use of more floor space than previously used containers. The container is available in several sizes to permit vertical stacking, of, particularly the smaller size units, while still allowing product access. The structure of the container insures shipping stability and the container is reusable after the product has been removed therefrom.

SHORT SUMMARY OF THE INVENTION

A shipping and display and reusable container for chain and various bulk goods, which includes a unit having a generally rectangular cross section and providing a generally rectangularly shaped front and side such that a number of containers may be arranged in side-to-side, abutting relation. The rectangular shape of the unit also conserves shipping space. A removable cover, provided over an upper corner portion, allows access to the chain or goods within the container and the available opening may be provided with a notch, receiving area, specifically for chain display, to retain at least one link of chain for access, display and removal purposes.

Strengthening columns are molded directly into the vertical sides of the container to insure against vertical collapse and, selectively, collapsible handle attachment means may be molded into at least one such column to house a selectively provided, shiftable handle, which nests into the top surface of the container when not in use.

The upper and lower surfaces of the container may also be molded for vertical nesting of one container upon the other.

BACKGROUND AND ADVANTAGES OF THE INVENTION

The prior art that applicant has found in both patent and commercial searching of the art is provided in the Information Disclosure Citation which shows that this invention is new to the art by absence of any applicable prior art.

In the past, carrying units for both shipping and displaying chain and other bulk articles often utilized fiber, round barrels or containers, from which the covers were removed for display and selling purposes. As is well known, display space in all sales, primarily those directed to retail sales, is at a premium and round containers occupy more space than rectangular containers that may be abutted in side-by-side fashion. Fiber containers also absorb moisture and become weak, which is often disastrous for shipping, with the result that the container may collapse while in an upright position and do not, in such condition, present an attractive display. Therefore the combination of being round and being fibrous has not resulted in a desirable unit for either shipping or sales, display and possible reuse purposes.

Chain has also been provided on reels and such reels were single use units and again did not effectively utilize floor or shipping space.

With applicant's unit, a container of sufficient shipping and article retaining strength is provided and manufacturing the same from plastic material prevents moisture absorption which has, in the past, caused weakness in fiber containers.

Primarily, the shape of the provided container results in effective and efficient floor display utilization and will allow for vertical stacking of the same to, again, add to floor and shelf space utilization.

The access opening provided in the container allows for easy access to the contained material, either chain or otherwise, while not detracting from the other qualities of the container.

Finally, the container has uses after the chain or other material has been removed which additional use is not available with fiber containers and, although this application is directed to containment, shipping and display of bulk chain, it will be obvious that other bulk materials may be readily shipped and displayed in the same.

It is therefore an object of the applicant's invention to provide a shipping and display container, which although the disclosure herein may be considered as particularly directed to use for chain, that provides an effective and strong shipping unit for various articles.

It is another object of the applicant's invention to provide a shipping and display container which is of a shape to effectively utilize floor and shelf space.

It is yet another object of the applicant's invention to provide a shipping and display container for chain as well as other bulk materials that provides sufficient shipping strength so as to be durable over a long period of time.

It is still another object of the applicant's invention to provide a shipping and display container for chain as well as other bulk materials which will allow for vertical stacking of the same and which may selectively include a handle, nestable on the upper surface thereof, to assist with the handling of the same.

These and other objects and advantages of the applicant's invention will more fully appear from the following description and claims.

SHORT DESCRIPTION OF THE DRAWINGS

DESCRIPTION OF PREFERRED EMBODIMENTS OF THE INVENTION

Figure 1:
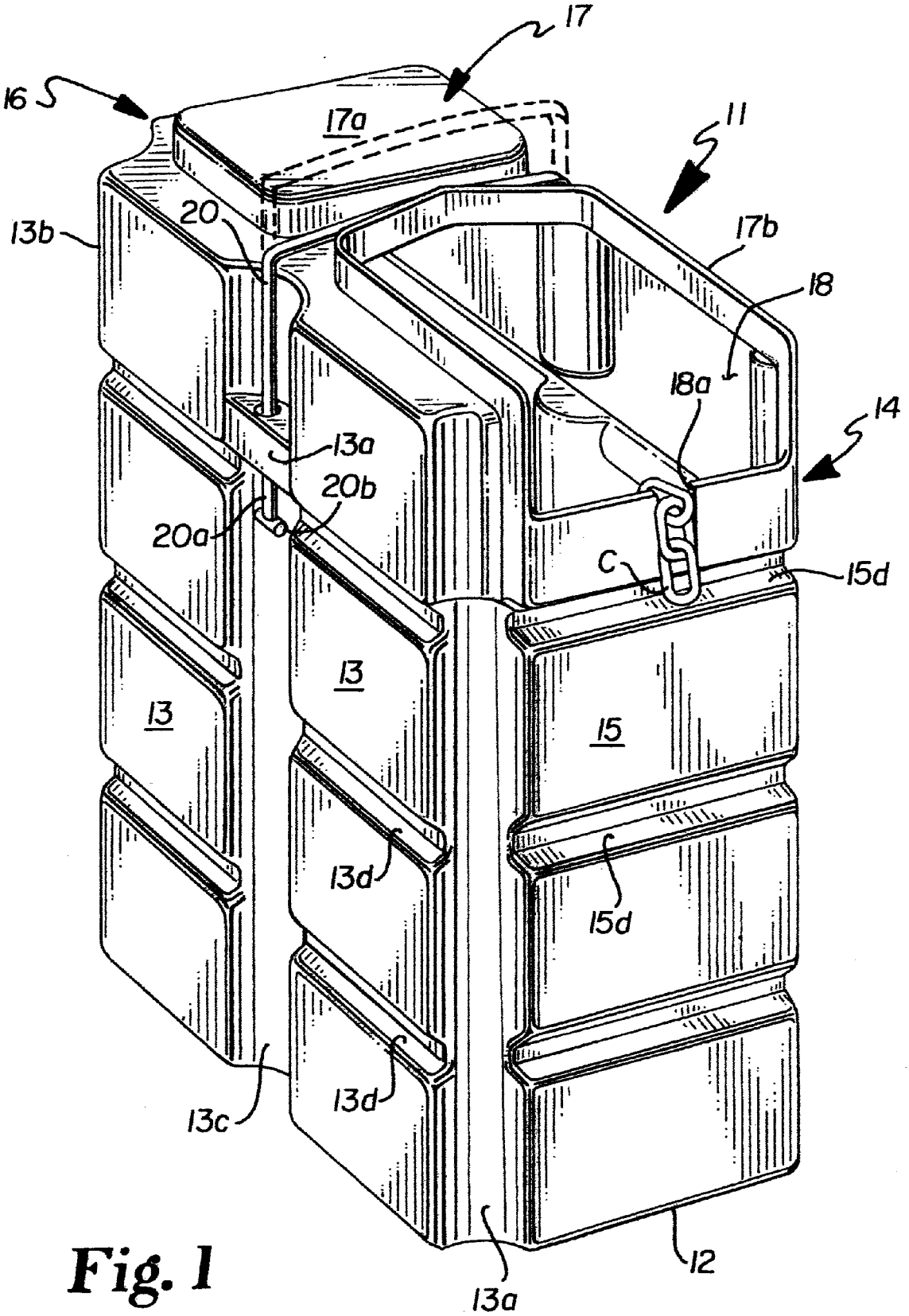
FIG. 1 is a perspective view of a container embodying the concepts of the applicant's invention, illustrating the same with its cover removed and having a chain section in accessible position through the provided access opening and further illustrating a selectively provided handle in its use position by dotted lines.

In accordance with the accompanying drawings, it should be understood that the containers are virtually identical in all structural elements, but which may differ in selective vertical and horizontal dimensions and, therefore, the same numerical or other identifying indicia is equally applicable to each of the views to indicate the same or similar parts. In those instances that the containers differ structurally, indicative indicia and the use description will clearly identify such element. The container sizes are chosen for the aspects of shipping, display and ultimate sale of chain and other bulk materials and the amount of chain or bulk material to be provided in a single unit, ultimately controls the size of the unit.

Again, though the description is directed for use of the container units for chain, it should be obvious that any bulk material may be accommodated therein.

Prior to the description, applicant provides the following example of the display area advantage gained through use of his concept. As only an example, a selected container, either container 11 or 30 may be of a rectangular cross section of 11 inches in width and 19 inches in depth and 24 inches in height which will provide sufficient volume for approximately 300 lbs. of bulk chain, which is dependent upon the link size and weight per link of the chain. This is compared to using round containers of an 18 inch diameter and 24 inch height which will also provide room for approximately 300 lbs of chain. Four (4) of the applicant's containers will then occupy the same lateral floor space, approximately four (4) linear feet, as three (3) round units, which will require staggering of position and therefore one of which will extend forwardly of the other two, with each of the round containers being capable of holding 300 lbs of chain. The applicant's containers then are capable of displaying approximately 1200 lbs of chain in a given lateral floor space which would, when using the round containers, be capable of displaying approximately 900 lbs of chain. This is one example of increasing display area whether chain or other bulk materials constitute the displayed product. In each case, a conservation of space is obtained.

Figure 3:
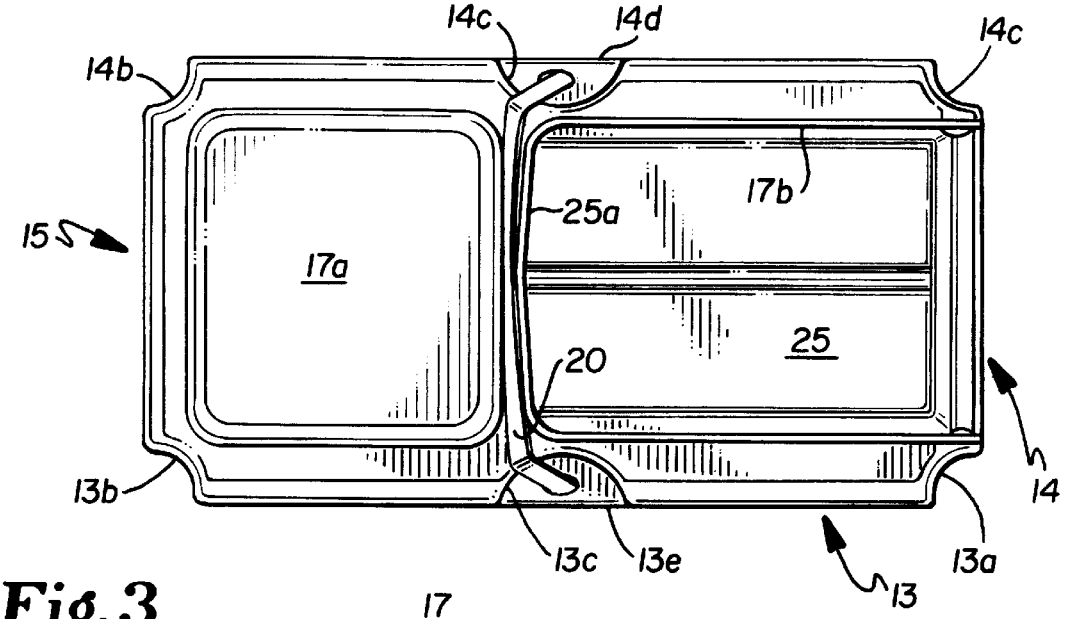
FIG. 3 is a top view thereof having its cover removed.

The basic units 11 designating the vertically larger and 30 designating the shorter of the units, each include a bottom 12, upstanding sides 13, 14, upstanding front and rear surfaces 15, 16 and a top 17. The upstanding sides 13, 14 may be described as being essentially planar but are provided with strength providing, vertically and inwardly directed columns 13*a*, 13*b*, 13*c* which are respectively arranged at the junctions of sides 13, 14 with the front 15 and rear 16 surfaces, the corner columns being respectively designated 13*a*, 13*b* and the intermediate column designated 13*c*. Similar columns are provided on side 14 of the unit 11 but due to the selection of Figures illustrated, the same only appear in the top view of FIG. 3. It is to be concluded that the sides 13, 14 are mirror images.

In addition to these vertical columns, a plurality of, preferably, horizontally arranged, inwardly directed, strength providing channels are provided on the units 11, 30. These additional channels may be diagonally positioned without departing from the scope of the invention. These channels are respectively designated 13*d*, on side 13, 14*d* on side 14, 15*d* on front 15 and 16*d* on rear 16. These channels are spaced, relatively equally, vertically along both sides 13, 14, front 15 and back 16 of the units 11, 30.

Intermediate columns 13*c*, 14*c* are, selectively, provided with a handle retaining block 13*e*, 14*e* and a formed, generally U-shaped handle 20 is provided for vertical movement therein with the bottom most ends 20*a* of the same being enlarged, as at 20*b*, to prevent continued upward movement of the same and provide a lifting stop for the handle 20. When the handle 20 is in the non-lifting or lowered position, it will nest between two raised sections 17*a*, 17*b* of the top 17.

Top 17 is provided with a first, closed, raised portion 17*a* and a second, upstanding flange portion 17*b* which flange 17*b* defines the opening 18 into the container 11 or 30. As shown in the drawings, this flange 17*b* completely surrounds opening 18 with such opening including both a portion of the top 17 of the units and a portion of the front side 15 of the units. An opening extension 18*a* is provided at the frontal, lower edge of opening 18 and, as illustrated in FIG. 1, this extension is designed to receive at least a single chain C link. In use, chain will be drawn through opening 18 and by inserting a link thereof in the lower opening 18*a*, a portion of the chain is maintained in an accessible position for sales exposure, prevention of free fall of the chain back into the container and further withdrawal of additional chain.

The opening 18 then is positioned at an upper corner junction of the units and is surrounded by a flange 17*b* which similarly is formed about this corner junction. By providing this opening at a corner, increased access is obtained and, even though the units, in the smaller sizes 30, may be stacked, the frontal portion of the opening 18 will allow access to the material contained therein. When the units are not vertically nested, the opening 18 exists on both the front and top and when the units are nested, the lower unit will allow access from the front thereof and the upper unit will allow both frontal and top access.

Figure 2:
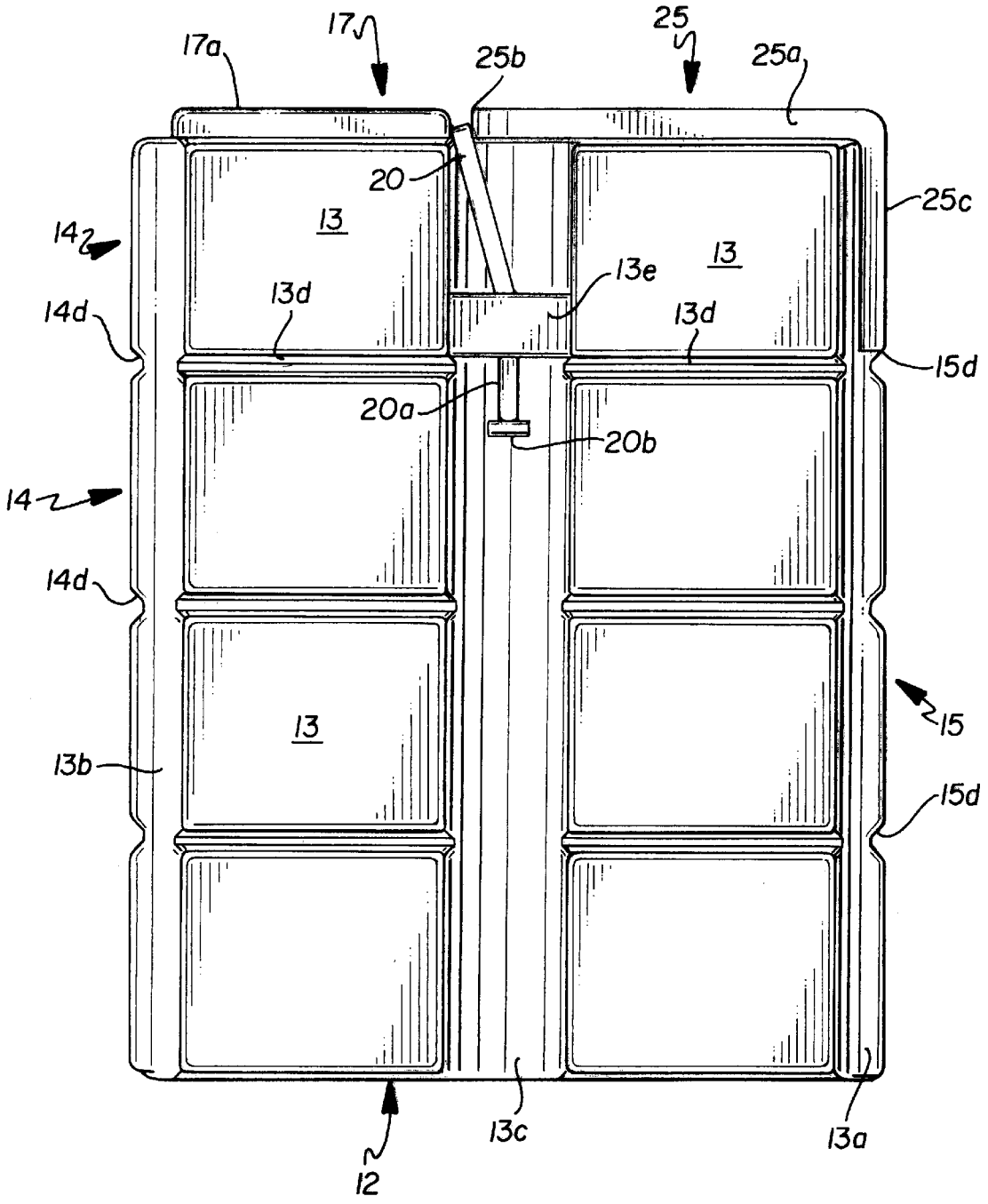
FIG. 2 is a side elevation of the unit illustrated in FIG. 1.
Figure 4:
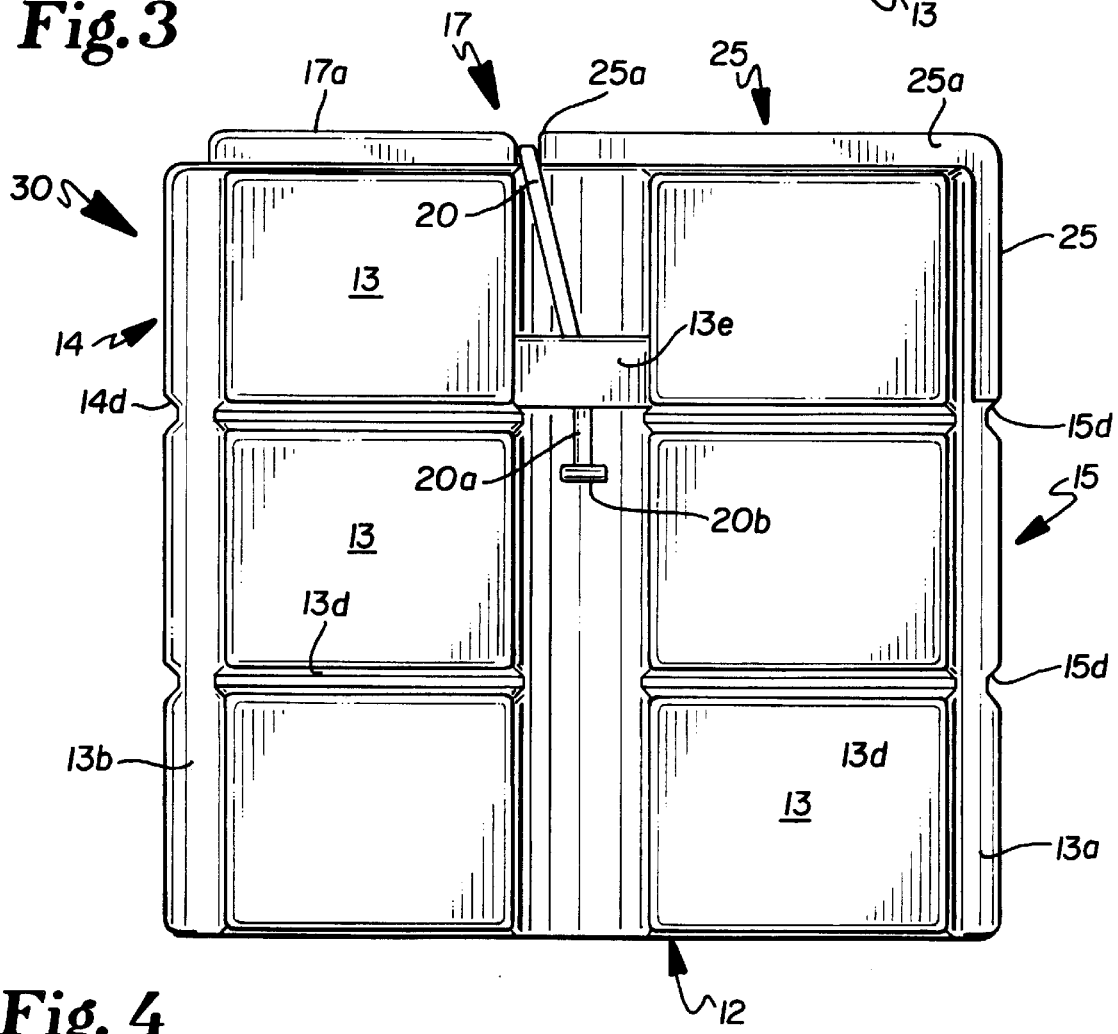
FIG. 4 is a side view of a container of a shorter vertical dimension and having its cover in closed position.
Figure 7:
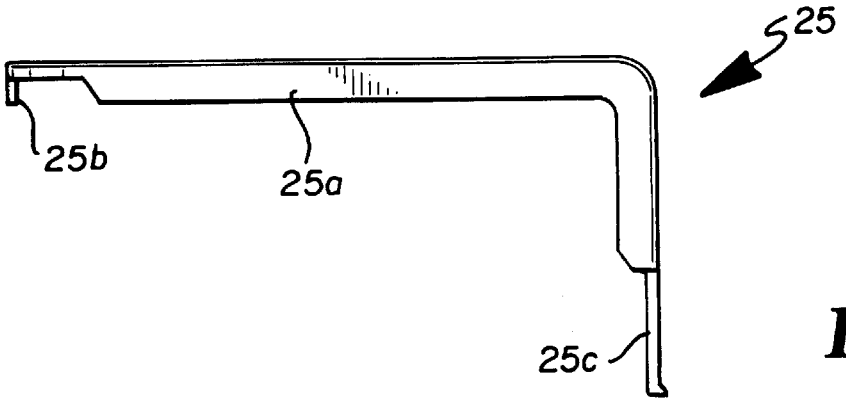
Figure 8:
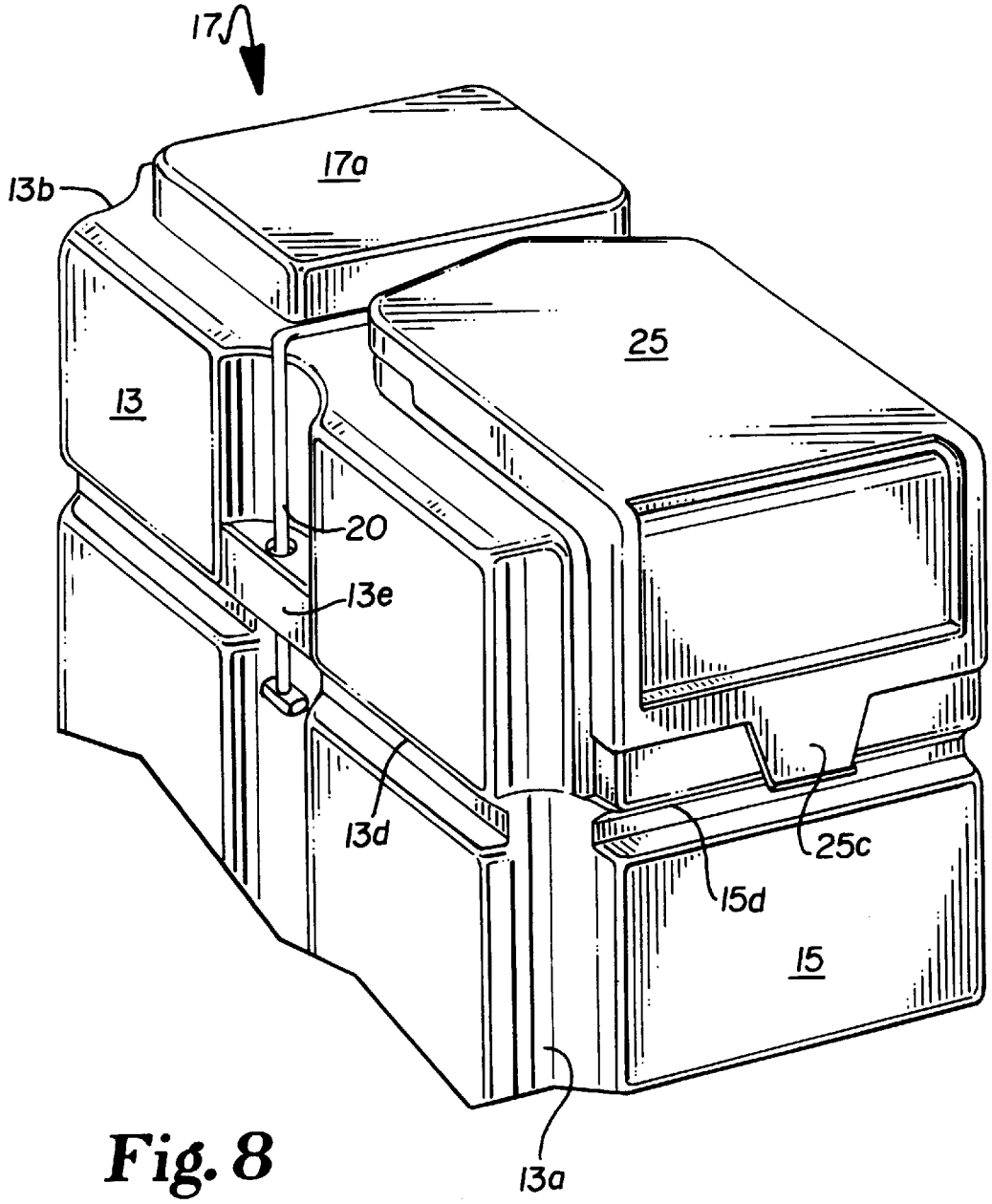
FIG. 8 is a perspective view of the container of FIG. 1 with the cover engaged with the access opening.

Cover 25 is illustrated in FIGS. 2, 4 and 7 and as illustrated, includes a generally L-shaped configuration to cover the opening on both the front 14 and top 17 of the units 11, 30. As best shown in FIG. 7, the L-shaped cover 25 includes a downwardly extending flange portion 25*a* at the corner thereof which extends a select dimension along both legs of the L-shape to engage the flange 17*b* about opening 18. An additional flange portion 25*b* is provided along the rear side of cover 25 to continue about flange 17*b* and an extending frontal tab 25*c* will extend over the link receiving opening 18*a* of opening 18. The cover 25 with its flange portions 25*a*, 25*b*, 25*c* and accommodating flange 17*b* of opening 18 are sized with respect to each other such that a locking and water tight effect is achieved by engagement of the cover to the flange.

Figure 5:
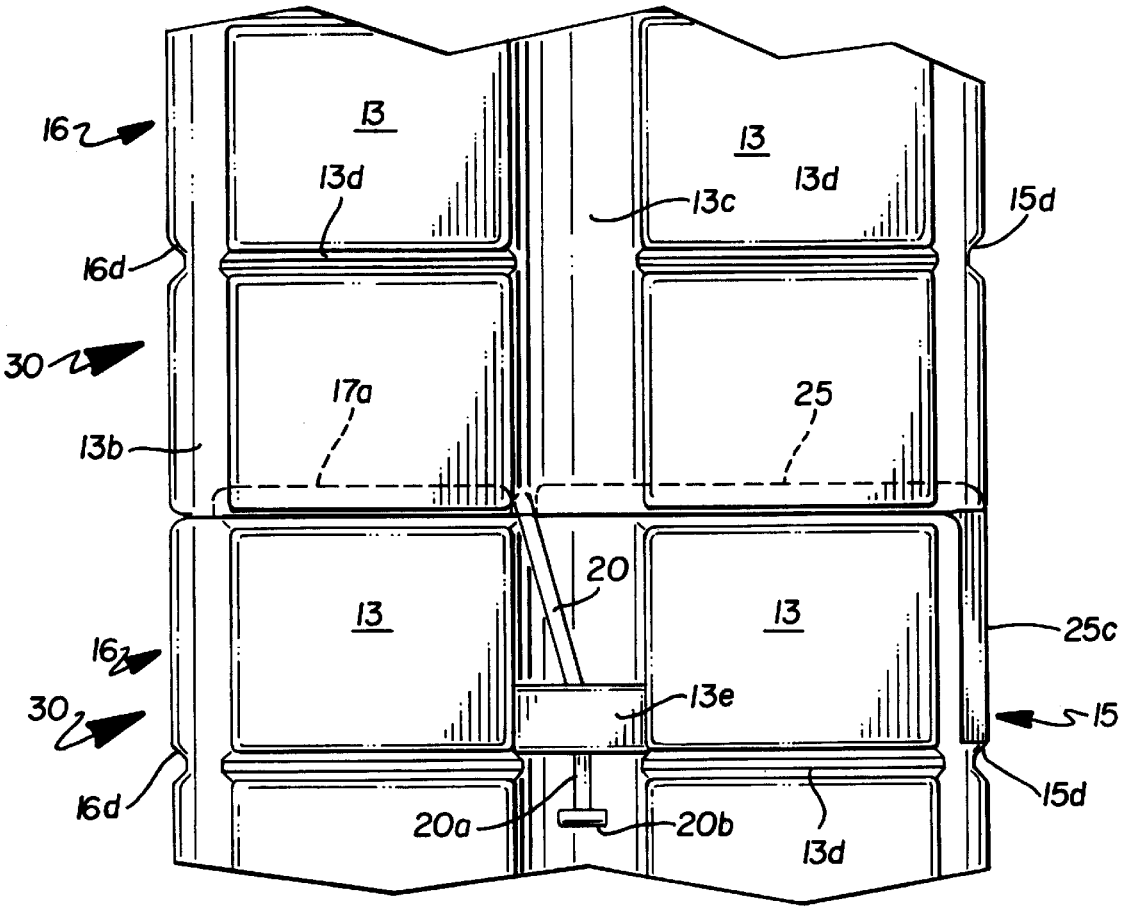
FIG. 5 is a side elevation of a pair of container units which are positioned in vertically nested position with the lower container having its cover in closed position.
Figure 6:
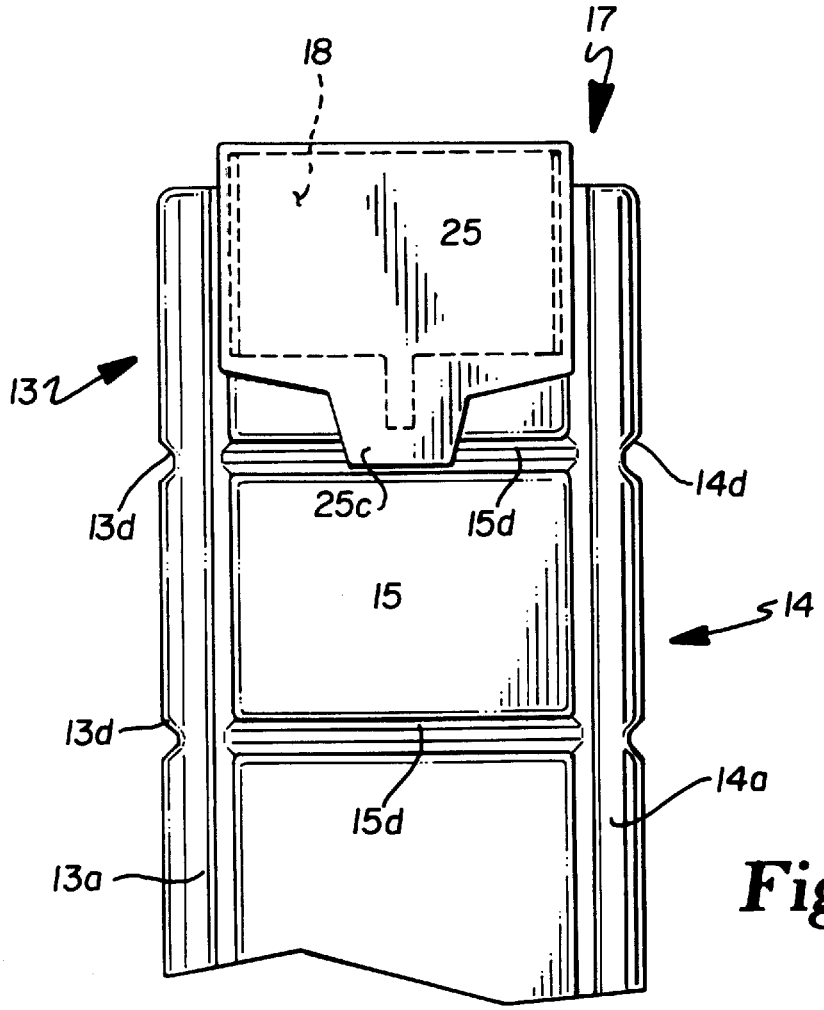
FIG. 6 is a front view of an upper portion of either size of the containers having the cover in closed position; and, FIG. 7 is a side view of the cover which fits containers of various sizes.

FIG. 4 illustrates a container unit 30 of a lesser vertical dimension but having the same structural elements as the larger container unit 11. Portions of two of such units 30 are illustrated in FIG. 5 showing the same in vertically nested fashion. To permit such nesting, the bottom 12 of the container 30 must be formed to receive the upstanding portion 17*a* and the cover flange portion 17*b* of the container 30 upon which it rests and nests. Although FIGS. 4 and 5 illustrate containers which are designated 30, they are otherwise structurally identical to the unit 11 and in actual practice, the larger units 11 may conceivably be molded with the same bottom 12 surface which would accommodate such larger size nesting and container interlock.

Similarly, the bottom 12 of the larger size unit 11 may be provided of any configuration which will provide added strength to the unit for shipping, storage and sales display usage. As the intended use for the container shown is for bulk materials, strengthening aspects of this bottom surface must be considered and many molding configurations will provide to do so.

It should be obvious that the applicant has provided a unique as well as substantially watertight container for various bulk materials which has built in strengthening features and which due to its rectangular cross sectional shape will provide planar sides which permit such containers to be positionable in adjacent side-to-side arrangement for both transportation and display purposes. Such side-to-side placement will provide a space reduction for both transportation and display in comparison to round or non-flat containers. Further the aspect of a dual facing opening for access to contained material allows stacking of containers with access being allowed to the lowermost container. The units, of either size are, further, usable for subsequent applications.

What is claimed is:

1. A shipping and display container for chain and other bulk goods, including:

a. a bottom, upstanding sides, front surface and rear surface, all being integral with said bottom and each other, to provide an interior of substantially rectangular cross section and a top integral with said sides, front and rear surface;

b. vertically arranged strengthening columns formed at least at the junctions of said sides, front and rear surfaces;

c. an access opening provided at the junction of said front surface and said top extending along a selected portion of said front surface and along a selected portion of said top surface; and, d. a closure member provided to cover said access opening;

e. at least one additional vertically arranged strengthening column provided in each of said upstanding sides intermediate of said front and rear surfaces; and f. handle means, said handle means including:

handle mounting members arranged in each of said at least one additional vertically arranged strengthening columns of each of said sides;

a generally U-shaped member having its legs slidably received in said handle mounting members and having the connective member between said legs spanning said top of said container; and, being shiftable from a first position adjacent said top to a position removed from said top.

2. The shipping and display container for chain and other bulk goods as set forth in claim 1 and generally horizontal strengthening reinforcing elements arranged in at least said upstanding sides.

3. The shipping and display container for chain and other bulk goods as set forth in claim 1, wherein;

a. said access opening is bounded by an outwardly directed flange; and, b. said closure member is provided of a singular, L-shaped element to be positioned over said flange and closing said opening.

4. The shipping and display container for chain and other bulk goods as set forth in claim 3 and said closure member including at least a partial flange directed inwardly thereof to be received to said outwardly directed flange bounding said access opening with engagement of said outwardly and inwardly directed flanges flanges providing the sole means for sealing said access opening.

5. The shipping and display container for chain and other bulk goods as set forth in claim 1 and an access opening extension being formed in said front surface and extending from said access opening.

6. The shipping and display container for chain and other bulk goods bulk materials as set forth in claim 1 wherein a. an upwardly, outwardly directed locating member is arranged on said top of said container; and, b. said bottom of said container being provided with an inwardly directed locating member receiving recess for positioning of a container of the same configuration upon said top of a lower container to provide nesting therebetween.

7. The shipping and display container for chain and other bulk goods as set forth in claim 6 and said bottom of said container being provided with a second, inwardly directed locating recess arranged to normally overlie said access opening of an underlying container.

8. The shipping and display container for chain and other bulk goods bulk materials as set forth in claim 2 and said vertical strengthening columns extending the entire height of the container.

* * * * *